United States Patent [19]

Szabo

[11] 4,019,559

[45] Apr. 26, 1977

[54] METHOD OF FORMING A FOUNDRY MOLD

[75] Inventor: Ervin I. Szabo, Manotick, Canada

[73] Assignee: Canadian patents and Development Limited, Ottawa, Canada

[22] Filed: Aug. 20, 1976

[21] Appl. No.: 716,358

[30] Foreign Application Priority Data

Dec. 30, 1975 Canada ..... 242825

[52] U.S. Cl. ..... 164/26

[51] Int. Cl.[2] ..... B22C 9/04

[58] Field of Search ..... 164/25, 26, 361; 260/DIG. 40

[56] References Cited

UNITED STATES PATENTS

| | | | |
|---|---|---|---|
| 3,270,382 | 9/1966 | Emblem et al. | 164/26 |
| 3,751,276 | 8/1973 | Beyer et al. | 164/26 X |
| 3,859,153 | 1/1975 | Beyer et al. | 164/26 X |

*Primary Examiner*—Ronald J. Shore
*Attorney, Agent, or Firm*—Francis W. Lemon

[57] ABSTRACT

A simple and economical method of forming a foundry mould for precision investment casting wherein the time period for allowing each applied refractory coating and stucco coating to set on a meltable mould former is substantially reduced by applying alternate coatings of immiscible, refractory particle binders to the mould former interspersed with stucco coatings, with at least one of the refractory particle binder coatings being in the form of a slurry containing refractory particles. This eliminates the necessity of having to allow one coating to set before the next one is applied. The alternate refractory particle binders used are a partially hydrolized, organo-silicon compound and an alcohol tolerant non-alkaline aqueous colloidal silica. Initially the mould former is coated with a refractory slurry having a suspended solids content in the range 30% to 50% by volume of the total slurry volume while the subsequent refractory slurries have a suspended solids content in the range 20% to 40% by volume of the total slurry volume.

7 Claims, No Drawings

METHOD OF FORMING A FOUNDRY MOLD

This invention relates to a method of forming a foundry mould.

Investment casting foundry moulds for precision investment casting are usually prepared by dipping a meltable mould former into a slurry containing the refractory particles and a binder to form a coating thereon, allowing the binder to set the coating, repeating the dipping and setting steps until a foundry mould is formed by the successive coatings, drying the foundry mould, and then melting and removing the mould former from the foundry mould.

While this method has proven to be very useful, the time required between each dip coating to allow each coating to dry has been found to be sufficiently long to make the process undesirably slow and costly.

Basically, the conventional foundry mould shell consists of alternating layers of fine and relatively coarse refractory particles, held in place by a suitable refractory binder. The first coating, which initially is in actual contact with the meltable mould former, and subsequently with the molten metal it will contain and shape, must perforce be of fine texture to repeat the meltable mould former pattern in faithful detail. The first coating is applied to the meltable mould former in the form of a slurry of maximum solids content consistent with adequate fluidity. This initial coating is then topped with a stucco layer of relatively coarser refractory particles.

The stucco layer of relatively coarse refractory particles fulfills a multiplicity of roles, namely:

i. It thickens the foundry mould shell, thereby strengthening it.

ii. It soaks up some of the suspending fluid from a slurry coating applied thereto and thus increases its viscosity and accelerates the arrest of draining of the suspending fluid.

iii. It forms nuclei on which shrinkage cracks may initiate. The cracks therefore will be numerous and small and cannot be penetrated by the liquid metal (under normal casting pressure).

iv. The rough surface to a small extent promotes drying.

v. The rough surface also provides a "key" for the next slurry coating.

vi. It may, by judicious selection, also promote the eventual removal of the foundry mould shell from the solidified metal casting therein.

The conventional method of placing the relatively coarse refractory particles on the slurry-wetted mould former varies, but in a great number of cases consists of immersing the slurry-wetted mould former in a fluidized mass of the stucco particles. In some instances, however, the first stucco layer is applied by "raining" the refractory particles on the slurry wetted mould former. The reason for this is said to be twofold:

a. in a fluidized bed the high air velocity imparts a great momentum to the refractory particles and may cause penetration through the initial slurry coating and b. the high air velocity may also dry the initial slurry coating, causing the formation of a dry skin on the mould former to which the stucco refractory particles will not adhere.

Following the application of the stucco layer, the coated mould former is allowed to dry. During this period the siliceous binder sets; in aqueous colloidal silica-based suspensions, by the progressive rejection of silica from the colloid; in the case of ethyl silicate-based suspensions, drying and simultaneous hydrolysis (as the alkoxide reacts with atmospheric moisture) also takes place.

When the siliceous binder is fully set, the mould former is usually immersed in a second refractory particle slurry, and then re-stuccoed, and these steps repeated sequentially a number of times until a sufficiently strong foundry mould is formed. The second slurry and subsequent ones are conventionally thinner than the one employed for the initial coating, partly to compensate for the increase in concentration that takes place when a portion of the liquid vehicle is soaked up by the dry layers underneath, and partly due to the realization that the firm first layer forms an adequately strong barrier against stucco particle penetration. Thus the advantage of speedy draining offered by thinner suspensions can be readily exploited. The protection afforded by the firm, initial coating also permits a stucco of yet coarser refractory particles to be used. Again, drying follows.

It is evident that, as previously stated, drying is the most time-consuming period of the foundry mould preparation; furthermore, the repeated handling for each and every dip/stucco layer also adds to the cost of production.

Various methods have been proposed whereby successive layers of slurry/stucco may be applied to the mould former without drying in between the applications of the slurry coatings. Attempts have been made to deposit a thick, heavy layer sufficiently strong to withstand handling and to contain the molten metal, in the shortest possible time. Such methods, if successful would greatly reduce the time required for mould preparation and would also eliminate the need to store coated mould formers during drying, thus resulting in a substantial reduction in the size of the mould preparation area required.

It has been suggested that rapid hardening of the slurry would offer one means by which to arrive at the desired end, and that this may be accomplished either by speeding up the evaporative drying of the slurry coating, or speeding up the hardening of the slurry coating by chemical means.

The former approach has proved to be limited in its scope, because removal of the volatiles is dependent on air velocity, the heat supplied to the slurry coating, and the rate of capillary diffusion of the liquid from the interior of the coating to its surface. It has also been found that the cooling caused by evaporation from the slurry coating causes some shrinkage in a mould former of, say, wax and, hence, in the (still pliable) coating thereon. On regaining ambient temperature the pattern expands and cracks the (now rigid) coating thereon. This phenomenon imposes severe limits on the extend to which drying of a slurry coating can be accelerated.

Accelerated hardening of the slurry coating by chemical means is the method which is widely used, since both the colloidal silica and the partially hydrolized alkoxy silane can be made to reject the silicon dioxide binder with relative ease.

One of the more commonly employed techniques involves the use of ammonia fumes to promote the decomposition of the organosilicate binder. This method, while rapid, necessitates the repeated handling of the workpiece or each and every occasion it has been given a slurry coat and subsequent stucco layer. It also necessitates the installation of additional equipment (gas chamber, ammonia metering system and a satisfactory venting arrangement) in which to conduct the hardening treatment.

Foundry moulds which have been hardened in this manner tend to be weaker than those prepared from an identical suspension and coated with similar, relatively coarser stucco particles the same number of times, but allowed to dry between the application of slurry coatings.

Techniques have also been developed for the accelerated hardening of aqueous, silica-bonded slurry coats. These range from the relatively simple one of dusting alkali earth oxide or carbonate on the still wet slurry coating or possibly mixing it into the fluidized stucco particle bed (in which instance the dust blown off must be periodically replenished), to the somewhat more elaborate ones which involve the use of a mixture of liquids and/or slurries. For example, mould formers may be coated with alternating layers of acidulated and alkaline slurries. Yet another technique utilizes an additional "dip", which hardens a slurry/stucco layer, after which the triple treatment of slurry/stucco/hardening dip is repeated. Care must be taken to avoid the contamination of the slurry by "dragout" of the "hardening" substance.

Whilst the processes outlined above do accelerate the hardening of the binder, they are not universally employed, owing to their various shortcomings.

It is an object of the present invention to provide an economical and simple method of a forming foundry mould wherein the time period between the application of slurry layers and stucco coatings to a meltable mould former is substantially reduced without affecting the integrity of the foundry moulds thus produced.

According to the present invention there is provided a method of forming a foundry mould, comprising:

a. applying an initial coating of refractory particles, to a mould former, from a first slurry comprising the refractory particles and a binder therefor, the first slurry having a suspended solids content in the range 30% to 55% by volume of the total volume of the slurry, then b. applying additional refractory particles to the mould former, in the form of a first stucco layer of relatively coarser refractory particles, then c. applying a second refractory particle binder coating to the stucco layer, then d. applying additional refractory particles, to the coated mould former, in the form of a second stucco layer of relatively coarser refractory particles, then e. applying a third refractory particle binder coating to the second, stucco layer, then f. repeating steps (b) to (e) in the same order and finishing with one of the refractory particle binder coatings, to form a foundry mould, then g. allowing the coatings and layers to set and dry, and then h. heating the mould former to melt it and then removing the molten mould former material from the foundry mould, and wherein the improvement comprises:

i. the refractory particle binders of steps (a) and (e) are substantially immiscible with the refractory particle binder of step (c), j. at least one of the refractory particle binders of steps (c) and (e) is a slurry containing refractory particles and having a suspended solids content in the range 20% to 40% by volume of the total volume of the slurry, k. each of the refractory particle binders comprises at least one substance selected from the group consisting of partially hydrolized, organo silicon compounds and alcohol tolerant non-alkaline aqueous colloidal silicas.

Using immiscible refractory particle binder coatings in this manner avoids the necessity of having to allow one coating to set before the next one is applied.

The criteria for the slurries are:

a. The initial slurry should be free flowing to ensure that the details of the pattern are faithfully reproduced and as well, promote the rapid drainage of the dragged-out excess. It should also be heavily loaded, i.e., be of maximum possible solids concentration to ensure that stucco penetration to the mould former does not occur. This is achieved by the first slurry having a suspended solids content in the range 30% to 55% by volume of the slurry. Preferably the suspended solids content is in the range 40% to 48% by volume of the slurry this provides a slurry which gives adequate protection against stucco penetration and yet one which is sufficiently fluid for drainage and fidelity.

b. The subsequent slurries should also be free flowing, and in addition, the binder and suspending vehicle of these slurries should be immiscible with the immediately, previously applied refractory particle binder. The free flowing characteristic is achieved by these slurries having a suspended solids content in the range 20% to 40% by volume of the total volume of that slurry. Preferably these slurries have a solids content in the range 30% to 40% by volume of the total volume of the slurry to provide a slurry which drains rapidly, contains sufficient vehicle to compensate for that soaked up by the stucco layer underneath and which contains sufficient "body to embed" that stucco layer.

c. Another point to consider is the possibility of adverse reaction between the subsequently applied refractory particle binders. Non-compatible binders and suspending vehicles may cause gelling of the adjacent refractory particle binder already on the mould former, which is deemed undesirable. Furthermore, the inevitable drag-out from a previously applied refractory particle binder would cause gelling in the next refractory particle binder unless elaborate precautions are taken.

This final consideration restricts the choice of aqueous colloidal silicas as one refractory particle binder to those known in the art as alcohol tolerant i.e. to those which tolerate alcohol without gelling, and/or being gelled by, the other refractory particle binder, and includes hybrid types or the acetone and/or alcohol substituted ones. As a further point, aqueous, refractory particle binders, if alkaline, would accelerate the gelling of the partially hydrolized ethyl silicate and so non-alkaline colloidal silicas are preferred.

A preferred alcolhol tolerant non-alkaline aqueous colloidal silica, refractory particle binder is one selected from alcohol tolerant non-alkaline aqueous colloidal silicas containing 20% to 50% by weight silicon dioxide. Another preferred non-alkaline aqueous colloidal silica, refractory particle binder is one selected from alcohol tolerant non-alkaline aqueous colloidal silicas containing 20% to 50% by weight silicon dioxide which, in the liquid phase has a portion of the water substituted by at least one liquid selected from the group consisting of alcohols and ketones.

A small quantity of sulphuric or hydrochloric acid, approximately 1 to 10 ml/l of slurry, will generally reduce the viscosity of alcohol tolerant non-alkaline aqueous, colloidal silica, refractory particle binders and thus promote draining of excess slurry as well as improve its fidelity or ability to reproduce detail.

The choice of an organo-silicate as a refractory particle binder is also an important one. For minimum miscibility with the aqueous, refractory particle binder, it should preferably not contain a large concentration of alcohol since short-chain alcohols are fully miscible with water as well as the organo-silicate refractory particle binder, and thus will be co-solvents. However, since alcohol is liberated during the hydrolysis of ethyl silicates, a compromise can be made by restricting the alcohol content to that of the hydrolysis product alone. This may be realized by conducting the reaction without the use of a co-solvent as described in an article "On the Hydrolysis of Ethyl Silicate — 40 without Co-Solvent", Ervin I. Szabo, Foundry Trade Journal, Vol. 133, Oct. 12, 1972. This article describes a method of preparing a partially hydrolized organo silicon compound from a condensed ethyl silicate yielding substantially 40% by weight silicon dioxide. There are various grades of ethyl silicate available, for example, tetra ethyl ortho silicate, condensed ethyl silicate, and the previously mentioned ethyl silicate —40 and while all are useful, generally the use of the first two is declining. Thus the choice of organo-silicates as a refractory particle binder is limited to partially hydrolized, organo-silicon compounds and includes, for example, oxy silanes such as methyl silicate, propyl silicate and other homologues thereof.

As hydrolysis without co-solvent produces a partially hydrolized, organo-silicon refractory particle binder with a greater concentration of silica, a stronger shell results. This may, in some instances, be undesirable and it may therefore be necessary to "cut", i.e., to dilute the refractory particle binder. The diluent must of necessity be immiscible with the aqueous, refractory particle binder. Low molecular weight aliphatic and aromatic hydrocarbons meet this requirement because they are readily miscible with the organic phase, provided that the hydrolysis is complete, i.e., free, unreacted water, is absent. In the presence of small quantities of water, mixtures of kerosene or benzene, etc., with alcohol or ethyl silicate, etc., the water containing alcohol phase will separate from the hydrocarbon phase. This phenomenon thus may be used to indicate the state of the reaction.

A number of preparations were made following the criteria given above. The following tables list, examples of the present invention, the particulars of satisfactory combinations of immiscible refractory particle binder coatings that have been successfully applied to mould formers.

Table 1.

| Non-miscible suspensions* | | |
|---|---|---|
| a) first slurry | | |
| Ethyl silicate binder | (as described above) | 1000 ml |
| SM-1 sintered mullite | (Cawood Wharton Co. Ltd., Belvedere, Kent, England) | 3100 g |
| b) second refractory particle binder coating | | |
| 1034a grade colloidal silica | (Nalco Chemical Co. Inc., Chicago, Illinois) | 1000 ml |
| with or without P1-W grade fused silica flour | | 1200 g |
| c) third refractory particle binder coating containing refractory particles | | |
| Ethyl silicate binder | (as described above) | 1000 ml |
| P-2 grade fused silica flour | (Nalco Chemical Co. Inc., Chicago Illinois) | 1500 g |

Table 1.-continued

| Non-miscible suspensions* | | |
|---|---|---|

*applying stucco between layers throughout.

Table 2.

| Non-miscible suspensions* | | |
|---|---|---|
| a) first slurry | | |
| Ethyl silicate binder | (as described above) | 1000 ml |
| SM-1 sintered mullite | (Cawood Wharton Co. Ltd., Belvedere, Kent, England) | 3100 g |
| b) second refractory particle binder coating containing refractory particles | | |
| 1034a grade colloidal silica | (Nalco Chemical Co. Inc., Chicago, Illinois) | 1000 ml |
| P1-W grade fused silica flour | | 1200 g |
| c) third refractory particle binder coating | | |
| Ethyl silicate binder | (as described above) | 1000 ml |

*applying stucco between layers throughout.

It should be mentioned that it is of no consequence whether an aqueous-based slurry is used, or one based on ethyl silicate for the first slurry so long as it is not miscible with the following, second refractory particle binder coating and it is heavily loaded to provide a barrier against stucco penetration.

The following Table III gives examples of aqueous first slurries:

Table III

| Aqueous First Slurries | | | |
|---|---|---|---|
| 1034a colloidal silica | (Nalco Chemical Co. Inc., Chicago, Illinois) | 1500 ml | 1500 ml |
| Water | | 1250 ml | 1250 ml |
| C71-FG alumina* | Aluminum Co. of Canada Ltd. | 4000 g | — |
| C71-FG alumina* | | 2000 g | — |
| C71-FG alumina* | | 1000 g | — |
| C71-FG alumina* | | 1000 g | — |
| SM-1 sintered mullite* | Cawood Wharton Co. Ltd, Belvedere, Kent, England | — | 3000 g |
| SM-1 sintered mullite* | | — | 1000 g |
| SM-1 sintered mullite* | | — | 1000 g |
| SM-1 sintered mullite* | | — | 750 g |

*milling between additions.

For stronger moulds the water content may be reduced and the 1034*a* colloidal silica refractory particle binder adjusted accordingly. For example, if the water content is reduced by 250 ml, the 1034*a* colloidal silica refractory particle binder is increased by the same volume. In this case, the second refractory particle binder coating may be replaced by the third refractory binder coating designated (c) in Table I and the third refractory particle binder coating may be either the second refractory particle binder coating designated (b) in Table I or a suitably diluted version of the slurries given in Table III, made, for example, by omitting the fourth increment of the respective refractories. From this it will be seen that the first and third slurries are not necessarily composed of the same substances.

The refractory particles of the suspensions may, for example, be powdered refractory oxides such as silica, alumina, and also refractory silicates such as mullite and zircon. The shell thickness can be built up to the desired level by following the sequence of using different coatings terminating with either the refractory particle binder with no refractory particles or the one containing refractory particles, though the latter is preferred.

Tests leading to the present invention have indicated that when neither of the second and third refractory particle binder coatings (which are immiscible with one another) contained refractory particles suspended therein the strength of the coating on a mould former is insufficient and coating is liable to sag.

I claim:

1. A method of forming a foundry mould, comprising:

a. applying an initial coating of refractory particles, to a mould former, from a first slurry comprising the refractory particles and a binder therefor, the first slurry having a suspended solids content in the range 30% to 55% by volume of the total volume of the slurry, then b. applying additional refractory particles to the mould former, in the form of a first stucco layer of relatively coarser refractory particles, then c. applying a second refractory particle binder coating to the stucco layer, then d. applying additional refractory particles, to the coated mould former, in the form of a second, stucco layer of relatively coarser refractory particles, then e. applying a third refractory particle binder coating to the second, stucco layer, then f. repeating steps (b) to (e) in the same order and finishing with one of the refractory particle binder coatings, to form a foundry mould, then g. allowing the coatings and layers to set and dry, and then h. heating the mould former to melt it and then removing the molten mould former material from the foundry mould, and wherein the improvement comprises:

i. the refractory particle binders of steps (a) and (e) are substantially immiscible with the refractory particle binder of step (b), j. at least one of the refractory particle binders of steps (c) and (e) is a slurry containing refractory particles and having a suspended solids content in the range 20% to 40% by volume of the total volume of the slurry, and k. each of the refractory particle binders comprises at least one substance selected from the group consisting of partially hydrolized, organo silicon compounds and alcohol tolerant non-alkaline aqueous colloidal silicas.

2. A method according to claim 1, wherein the first slurry has a suspended solids content in the range 40% to 48% by volume of the total volume of the first slurry.

3. A method according to claim 1, wherein each of the refractory particle binders of steps (c) and (e) which contains refractory particles has a suspended solids content in the range 30% to 40% by volume of the total volume of the second slurry.

4. A method according to claim 1, wherein the partially hydrolized, organo silicon compound is a condensed ethyl silicate yielding substantially 40% by weight silicon dioxide.

5. A method according to claim 1, wherein the alcohol tolerant non-alkaline aqueous colloidal silica is selected from alcohol tolerant non-alkaline aqueous colloidal silicas containing 20% to 50% by weight silicon dioxide.

6. A method according to claim 1, wherein the alcohol tolerant non-alkaline aqueous colloidal silica is selected from alcohol tolerant non-alkaline aqueous colloidal silicas containing 20% to 50% by weight silicon dioxide which, in the liquid phase, has a portion of the water substituted by at least one liquid selected from the group consisting of alcohols and ketones.

7. A method according to claim 1, wherein the alcohol tolerant non-alkaline aqueous colloidal silica contains, for each litre of slurry, 1 to 10 ml of an acid selected from the group consisting of sulphuric and hydrochloric acids.

* * * * *